US005098069A

United States Patent [19]

Wanetzky et al.

[11] Patent Number: 5,098,069

[45] Date of Patent: * Mar. 24, 1992

[54] EQUIPMENT AND REGULATING MEANS FOR RECOVERING METAL-CARBIDE SCRAP BY ALLOYING

[75] Inventors: Erwin Wanetzky, Gross-Krotzenburg; Franz Hugo, Aschaffenburg; Fernand Kuhlmann, Seligenstadt, all of Fed. Rep. of Germany

[73] Assignee: Leybold-Heraeus GmbH, Cologne, Fed. Rep. of Germany

[ * ] Notice: The portion of the term of this patent subsequent to Oct. 4, 2000 has been disclaimed.

[21] Appl. No.: 265,012

[22] Filed: Oct. 31, 1988

Related U.S. Application Data

[60] Division of Ser. No. 96,813, Sep. 10, 1988, Pat. No. 4,818,282, which is a continuation of Ser. No. 435,768, Oct. 21, 1982, abandoned.

[30] Foreign Application Priority Data

Nov. 7, 1981 [DE] Fed. Rep. of Germany ..... 3144284

[51] Int. Cl.[5] ..... F27D 7/06

[52] U.S. Cl. ..... 266/87; 266/149

[58] Field of Search ..... 266/149, 87

[56] References Cited

U.S. PATENT DOCUMENTS 4,407,488 10/1983 Wanetzky et al. ..... 266/148

*Primary Examiner*—Melvyn J. Andrews

*Attorney, Agent, or Firm*—Max Fogiel

[57] ABSTRACT

The invention concerns a method, equipment and a regulating means for use in recovering metal-carbide scrap by alloying. This is carried out by treating the scrap with a low melting point metal which brings the metal-carbide matrix into solution at temperature above the melting point of the alloy formed. The treatment is carried out in a container in the presence of inert gas, the pressure of which is gradually reduced following completion of the alloying process, the resultant metal vapor being condensed.

To solve the problem of producing, in the resultant residue, a proportion of low melting point metal of less than 100 ppm and of preventing condensation of the metal vapors on the container, it is proposed in the invention that the metal-carbide scrap and the low melting point metal should be alloyed with each other in an inner chamber arranged within the container. The metal vapor and the inert gas are passed out of this inner chamber on to the condensation surfaces, and the inert gas, containing no metal vapors, is cycled by way of the inner chamber. The metal vapor then serves as a means for inducing flow of the inert gas.

3 Claims, 1 Drawing Sheet

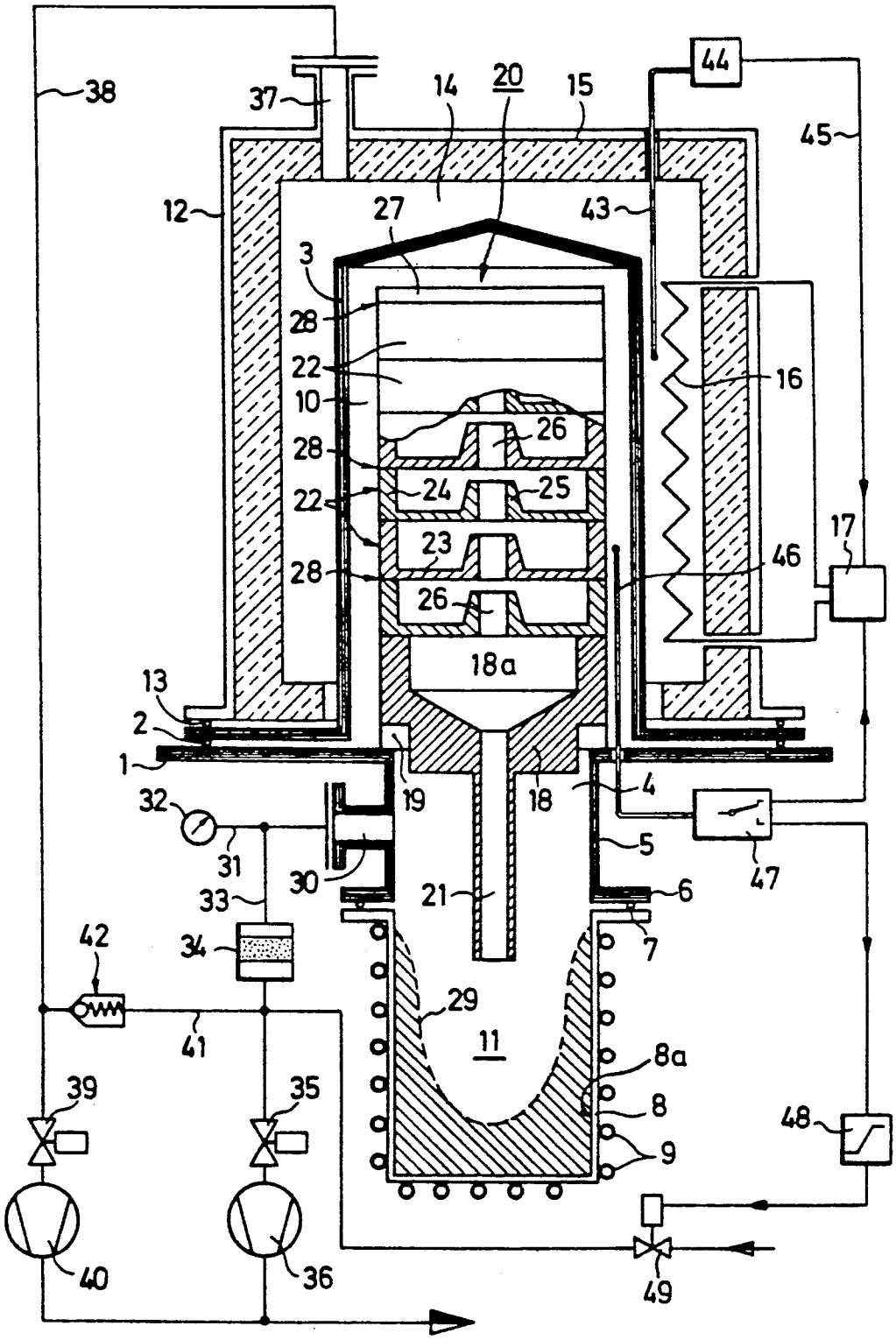
38
37
14
20
15
44
45
12
27
43
3
28
22
10
16
26
28
24
25
22
23
17
46
28
26
18a
13
2
1
19
18
4
32
31
5
47
30
21
6
33
7
42
34
29
41
11
8a
39
35
8
48
9
40
36
49

EQUIPMENT AND REGULATING MEANS FOR RECOVERING METAL-CARBIDE SCRAP BY ALLOYING

This is a division of application Ser. No. 096,813 filed Sept. 10, 1987, now U.S. Pat. No. 4,818,282 which is a continuation of Ser. No. 435,768 filed Oct. 21, 1982, abandoned.

The invention concerns a method of recovering metal-carbide scrap by treating the scrap with a low melting point metal, which brings the metal-carbide matrix into solution, at temperature above the melting point of the alloy formed, in a container in the presence of inert gas, in which method, first the alloying process is carried out at pressures above approximately twice the partial pressure of the low melting point metal and then the low melting point metal is vaporized at pressures below 1 mbar and is condensed on condensation surfaces.

Metal-carbide scrap occurs in considerable quantities, for example in connection with worn tools used in the machining of metals. A known example is constituted by what are called "turn-over plates". A problem that arises in this connection is that of recovering the metal-carbide scrap so that it can be used again in a suitably pure form as a starting material or as part of a mixture. The main constituent of the metal-carbide metal is cobalt.

A known method of the initially stated kind is based on the solubility of the metal-carbide matrix in a low melting point metal, such as zinc, for example. Depending upon the cobalt content of the metal carbide, such quantity of zinc is added to the scrap that an alloy having a solidus temperature of approximately 820° C. is formed. Zinc is a metal having a very high vapour pressure, so that the alloying phase is carried out at an elevated protective-gas pressure, for example at a pressure of approximately 1500 mbars. The zinc penetrates the metal-carbide matrix by diffusion and breaks up the metal-carbide lattice. After the zinc has been driven off, all that remains in the equipment is a "cake", which is ground down in a comminuting process to form a fine powder. This powder is retrieved for further use. In addition to zinc, cadmium may also be considered for use as the low melting point metal.

The known method exploits the partial pressure gradient in the zinc vapour between the heated alloying zone and the condensation surfaces, as well as the rate of diffusion of the zinc molecules between these zones. The concentration gradient is determined by the temperature gradient in the equipment required for carrying out the method, whereas the evaporation rate is determined by the rate of diffusion of the zinc molecules in the inert-gas atmosphere.

In the known method, the metal-carbide scrap is introduced, together with granulated zinc, into a crucible open at the top. To prevent the zinc from reacting in a harmful manner with the material of the crucible, the latter is made of graphite which is resistant to zinc. Two considerable disadvantages are, however, associated with this step:

In the first place, even a marked reduction in pressure in the container, following formation of the alloy, does not suffice to reduce the zinc content in the residue to values that are appreciably below 400 ppm. However, a high zinc content of this kind is too great to permit the recovered scrap to be used again, since such zinc content does not enable sufficient strength and length of service life to be obtained in the new metal-carbide tools. Consequently, it became necessary to apply further treatment to the embrittled residue involving additional complicated methods aimed at a zinc content of less than 400 ppm.

A further considerable disadvantage of the known procedure results from the screen connection between the contents of the crucible and the inner surfaces or components of the container. Consequently, it has not been possible to prevent the vaporized zinc from condensing, to some extent, on the components or inner faces of the container. Not only did these amounts of condensate constitute losses as regards the quantities of material deposited in the actual condensing vessel, but they also represented an undesirable contamination of the container and its components. Of very special importance is that zinc tends to react in an undesirable manner with the condensation surfaces and to form alloys which finally lead to the destruction of the components concerned.

In what is known as hot galvanizing, use is made of that inherent property of zinc that enables its contact surface to enter a normal serration. Whereas the very great adhesive strength of the zinc coating is extremely desirable in the end products produced in this way, the almost unbreakable connection between the zinc and the condensation surface is an undesirable subsidiary result when, for example, the condensed zinc has to be cleaned off the wall of the container at certain spaced areas. This is a practically insoluble problem.

An object of the present invention is, therefore, to provide a method of the initially described kind whereby the proportion of the low melting point metal left over in the residue can be reduced in a single operation to less than 100 ppm, and preferably less than 50 ppm, and wherein no metallic vapours are deposited on the inner faces or components of the container.

According to the invention and in the initially described method, this object is achieved in that the metal-carbide scrap and the low melting point metal are alloyed with each other in an inner chamber which is arranged in the container and from which the metal vapour and the inert gas are directed on to the condensation surfaces, and in that the inert gas, released from the metal vapours, is recycled through the inner chamber.

The inner chamber referred to is essential to the equipment for carrying out the method of the invention. It is to be understood as being a component of the container that affords to the metal vapours no free passage other than that leading to the condensation surfaces. The inner chamber is closed against the metal vapours in substantially all directions, and it has only one opening for passage of the metal vapours and through which these vapours pass directly on to the condensation surfaces. The inner chamber should, however, be sufficiently permeable by the inert gas present in the container to enable the gas to be cycled through the inner chamber. For this purpose the inner chamber may have extremely small openings or gaps, which preclude a screen connection between the contents of the inner chamber and the inner faces of the container or its components. At the same time, the flow paths for the inert gas in the walls of the inner chamber are so narrow that flow of metal vapour in the opposite direction is prevented.

By means of the arrangement in accordance with the invention, the vaporized metal molecules are moved in a preferential direction, i.e. towards the condensation surfaces. Thus, a motional mechanism is brought into action whereby the inert gas within the equipment is cycled between the inner chamber and the condensation surfaces.

This effect can be compared with the mechanism of the action of a diffusion pump. Since the inert gas escapes again from the condensation unit and enters the inner chamber through the above-described flow ducts, it is also cycled without the use of mechanical means such as circulating pumps, and simply as a result of the action of the stream of metal vapour. This stream of inert gas also prevents the flow of metal vapours in the opposite direction.

Since an appropriate configuration of the condensation surfaces easily renders it possible to condense the metal vapours to such an extent that the inert gas is completely freed from these vapours when it enters the container, the penetration of metal vapours in the direction of the inner surfaces and components of the container is prevented in this way. To some degree, the inert gas acts as a gas for flushing the space between the inner chamber and the wall of the container, and this leads to the equipment having an extremely lengthy service life.

Furthermore, the result of the above-described motional mechanism is that, in a single operation, the amount of low melting point metal in the residue ("cake") can be reduced to less than 100 ppm, and advantageously to less than 50 ppm.

Circulation of the inert gas interferes, in a positive sense, with the partial pressure gradient of the metal vapour corresponding to the temperature difference. A zone of low concentration of inert gas develops within the inner chamber, so that vaporization of metal can take place practically unimpeded. Outside the inner chamber, a greater density of inert gas/and therefore increased protection of the wall of the container against attack by the metal vapour occur. The above-described motional mechanism is intensified when the total pressure in the condensation unit corresponds to the partial pressure of the metal vapour in the inner chamber.

Furthermore, in the known method and upon excessively rapid reduction in pressure, the associated excessive extraction of vaporizing heat results in the danger of a fall below the solidus line of the alloy formed and therefore of destruction of the inner chamber, i.e. the crucible, or of the vessel forming the inner chamber.

To prevent this and in accordance with a further feature of the invention, it is proposed that the temperature of the alloy be regulated through the pressure in the container. This preferably takes place by determining the temperature of the alloy directly or indirectly (for example by way of the temperature of the wall of the inner chamber) and thereby, at a given thermal capacity, regulating the suction capacity of the vacuum pumps in such a way that the temperature of the inner container is kept above a predetermined required temperature. Regulation of the suction capacity of the pumps, understood as relating to the container, can also be achieved by admitting foreign gas into the suction pipe by way of a regulating valve.

The temperature of the inner chamber therefore remains substantially constant, since small changes in temperature cause large changes in vapour pressure, whereas the vaporization rate is proportional to the quantity of heat applied. The danger of solidification of the alloy melts is to a large extent precluded in this way.

The invention also relates to equipment for performing the method, which equipment, in accordance with a further feature of the invention, is characterized in that the inner chamber consists of stackable crucibles each with an annular channel formed therein, which crucibles are placed one upon the other to leave capillary or diffusion gaps between them, and have central aligned vapour ducts, which are open only towards the condensation surfaces, and in that a return-flow duct for the inert gas is present below the inner chamber.

Finally, the invention also concerns a regulating means for performing the method, which means, in accordance with a further feature of the invention, is characterized by a temperature sensor associated with the inner chamber, and a pressure regulator, which is arranged downstream of the temperature sensor and regulates the vacuum in the container in such manner that the temperature of the inner chamber is kept above a predetermined required value.

Further advantageous forms of the subject-matter of the invention are set forth in the other subsidiary claims.

An embodiment of the subject-matter of the invention will now be described in greater detail by reference to the single accompanying drawing, which shows a vertical section through the complete equipment with the necessary additional apparatus.

The drawing shows a base plate 1 on which rests a container 3, a sealing member 2 being interpolated between said plate and container, which is in the form of a hollow cylinder open at the bottom. The base plate 1 has an opening 4 which is coaxial with the container and underneath which is attached a port 5 having a flange 6.

Connected to the flange 6 by way of a sealing member 7 is a condensation unit 8 which has a condensation surface 8*a* and which consists of cylindrical pot, on the exterior of which is fitted a cooling coil 9. The internal cross-sections of the port 5 and the condensation unit 8 are roughly the same.

The container 3 encloses a heating chamber 10, whereas the condensation unit 8 encloses a condensation chamber 11. These two chambers communicate with each other but form a unit which is closed off from the exterior.

The container 3 is surrounded by a coaxial heating hood 12, which, at its lower end, is supported on the annular flange, not shown in detail, of the container 3 and encloses a chamber 14 which is gas-tight with respect to the container; a sealing member 13 is fitted between the heating hood and said annular flange. The heating hood 12 is lined with a heat-insulating means 15, within which is arranged a heating device, symbolized by the heating element 16. The heating capacity can be varied by means of a setting device 17.

Located in the lower part of the container 3 is a support member 18, which substantially takes the form of a body of a rotation and which is supported on the base plate 1 in such a way that the cross-section of the opening 4 is not completely closed off. This is achieved by means of a plurality of openings which are formed in the zone of the outer lower edge of the support member 18 and which form the radial aperture and leave unoccupied cross-sectional areas that are large enough to form a circulatory path for the inert gas. Collectively, the openings form a return-flow duct 19. In its interior, the support member 18 has a substantially funnel-shaped cavity 18*a*, at the bottom of which is connected a coaxial vapour conduit 21.

An inner chamber 20 rests on the support member 18 which, for this purpose, has an annular edge. The annular chamber is made up of a plurality of stackable crucibles 22, each with an annular channel formed therein and all having the same outside diameter as the support member 8. The channelled crucibles each have a bottom 23, and outer wall 24 of constant height and an inner wall 25 which encloses a vapour duct 26. The bottom 23 of each crucible is flat, and the height of the inner wall 25 is less than that of the outer wall 24, so that a radial gap is created, and the vertical dimension of this gap is great enough to permit the flow of vapour that is set up. All of the channelled crucibles are formed as bodies of rotation, so that all of the vapour channels 26 are aligned with each other and with the vapour conduit 21. The top channelled crucible 22 is closed off by a cover 27 which also closes the vapour duct.

The support member 18, the channelled crucibles 22 and the cover 27 are made of a material, for example graphite, which resists attack by the substances to be processed. By means of the described stacked arrangement of the channelled crucibles 22, capillary gaps 28 are formed between the contact faces, which are annular faces, and these gaps, although permitting inward flow of the inert gas through the cylindrical enveloping surfaces of all of the channelled crucibles, do not, however, permit flow of vapour in the opposite direction.

It will be seen that the vapour conduit 21 discharges into the condensing unit 8. The broken line 29 indicates the surface of the condensate deposited in the condensing unit, the surface being the particular condensation surface. While the equipment is operating, the mixture of metal-carbide scrap and low melting point metal is contained, in the at least partially molten state, in the annular spaces defined by the outer walls 24 and the inner walls 25 of the crucibles. Because of the developing stream of vapour within the vapour ducts 26 and the vapour conduit 21 and because of the drop in the partial pressure of the vapour as it moves towards the condensation surfaces in the condensing unit 8, efficient circulatory flow of the non-condensible inert gas occurs, which gas accompanies the metal vapour into the condensing unit, but leaves this unit by way of the return-flow duct 19 without any metal vapour content, and enters the annular gap between the container 3 and the inner chamber 20. From here, the inert gas again passes through the above-described capillary gaps into the inner chamber 20, so that the cycle is repeated.

The required operating pressure in the container 3 is produced in the vacuum zone by a suction port 30, which by way of a pipe 31, communicates with a pressure gauge 32 and, by way of a pipe 33, a filter 34 and a valve 35, is connected to a vacuum pump 36.

Pressures of roughly similar magnitude can be produced in the heating chamber 11 as well as in the gas-tight chamber 12 for the purpose of depressurizing the container 3. This is achieved by providing the heating hood 12 with a port 37 from which a pipe 38 runs to a second vacuum pumps 40 by way of the valve 39. The suction sides of the vacuum pumps 36 and 40 are interconnected by a pipe 41 in which is provided a non-return valve 42.

Fitting in the gas-tight chamber 14 is a temperature sensor 43 which, by way of a temperature limiting device 44 and a contol pipe 45, acts on the setting member 17 to effect limitation of temperature.

Provided within the container 3 in the immediate vicinity of the inner chamber 20 is a further temperature sensor 46 which, by way of a reversing switch 47, optionally acts on the setting member 14 or a pressure regulator 48. By these means it is possible to regulate the temperature of the melt in dependence upon pressure, since small changes in temperature bring about large changes in the vapour pressure. The vaporization rate is proportional to the quantity of heat applied. When the temperature of the melt, i.e. of the channelled crucibles, is picked up by means of the temperature sensor 46, it is possible, by regulating the pressure, to ensure that the pressure does not drop to such extent that the melt solidifies in the channelled crucible 22. Instead, the temperature in the channelled crucibles can be kept substantially constant.

EXAMPLE

Each of the channelled crucibles is loaded with metal carbide and granulated zinc in equal proportions by weight, and the crucibles are stacked one upon the other as illustrated in the drawing. After the container 3 and the heading hood 12 have been mounted and the condensing unit 8 has been fitted, the equipment is evacuated to the lowest possible oxygen partial pressure.

Argon is then introduced through the suction port 30 by way of the regulating valve 49 until a pressure of 1500 mbars obtains in the container (the valve 35 is closed, and the non-return valve 42 acts as a barrier in this pressure-loading direction). The heating system, is then switched on and the temperature raised to 850° C. by way of a programme transmitter. The rise in temperature takes place on the basis of a ramp function. Attainment of the maximum temperature is followed by an isothermal diffusion period which, depending upon the size of the scrap parts that are to be embrittled, may amount to several hours. After the scarp parts have been completely permeated with zinc, the temperature of the alloy is raised to 920° C. and at the same time the argon pressure is reduced. If the argon pressure in the container corresponds to the vapour pressure of the zinc at this temperature, then the zinc is carried from the channeled crucibles into the condensing unit by way of logically by way of the thermal loading of the condensing unit 8.

From this moment on, heating is carried out at constant capacity, whereas the temperature is regulated by way of the argon pressure. Constant temperature assumes constant lowering of pressure. A diminishing temperature causes a constant pressure i.e., a rise in pressure by a certain amount with a specific holding time. Correction of the capacity, that is necessary because of the change in the transfer of heat between the channelled crucibles and the alloy, is carried out by means of a programme transmitter. The pressure, controlled in this manner, is reduced to the medium-high vacuum range of approximately $5\times10^{-2}$.

At the end of the process, the grooved crucibles were found to contain "cakes" as they are called, consisting of a friable mass in which a residual zinc content of approximately 45 ppm was determined. New metal-carbide tools of excellent quality could be produced from the powder concerned by the usual recovery processes.

The expression "capillary gap" is to be understood as meaning an interstice between the outer wall of a crucible and the edge of the cover, such gap being defined, for example, by two planar circular surfaces on the channelled crucible and on the cover, when the cover rests, by the normal surface irregularities (machining score lines), on the edge of the crucible. The same applies as regards the capillary gap when it is formed between two channelled crucibles. The capillary gap may also be extended by a screw-thread, a labyrinth or the like. The width of the gap should not exceed approximately 0.1 mm. The limiting value can be determined by test; it is reached when the metal condenses on the wall of the container.

We claim:

1. An arrangement for recovering metal-carbide scarp by treating the scrap with a low melting point metal, comprising: a container with an inner chamber for alloying metal-carbide scrap with a low melting point metal in said inner chamber in the presence of inert gas for bringing a metal-carbide matrix into solution at temperatures above the melting point of the alloy formed; means with a single opening and condensation surfaces; means for directing metal vapor and inert gas for said inner chamber through said single opening onto said condensation surfaces, inert gas released from metal vapors being circulated through said inner chamber, said alloying of metal-carbide scraps with said low melting point metal being carried out at pressures above substantially twice the partial pressure of the low melting point metal; means for vaporizing the low melting point metal at pressures below 1 mbar before condensing on said condensation surfaces; said container and said inner chamber having an annular gap therebetween; means for recirculating inert gas released from metal vapors from said condensation surfaces through a closed gas path formed by said annular gap between said container and said inner chamber, at least on capillary gap in said inner chamber, a vapor duct between said inner chamber and said condensation surfaces, and a return flow opening between said condensation surfaces and said container; crucibles stacked within said inner chamber to preclude a connection between contents of said inner chamber and inner faces of said container, said capillary gap comprising a gap left between said crucibles, whereby penetration of metal vapor in direction of inner surfaces and contents of said container is prevented.

2. An arrangement as defined in claim 1, wherein each crucible has an annular channel formed within said crucible; said crucibles being stacked one upon the other to leave capillary gaps between said crucibles; said crucibles having central aligned vapor ducts open only towards said condensation surfaces; and a return-flow duct for the inert gas below said inner chamber.

3. An arrangement as defined in claim 1, including a temperature sensor in said inner chamber; a pressure regulator arranged downstream of said temperature sensor for regulating vacuum in said container.

* * * * *